US005496038A

United States Patent [19]

Kangsanaraks

[11] Patent Number: 5,496,038

[45] **Date of Patent: *Mar. 5, 1996**

[54] CARD GAME

[76] Inventor: Adisorn Kangsanaraks, 2658 Karen Ct. #621, Las Vegas, Nev. 89109

[ * ] Notice: The term of this patent shall not extend beyond the expiration date of Ser. No. 5,366,228.

[21] Appl. No.: 394,272

[22] Filed: Feb. 24, 1995

[51] Int. Cl.[6] ..... A63F 1/00

[52] U.S. Cl. ..... 273/292

[58] Field of Search ..... 273/292, 274, 273/309, 85 CP

[56] References Cited

U.S. PATENT DOCUMENTS

| | | | |
|---|---|---|---|
| 4,659,087 | 4/1987 | Shen et al. | 273/274 |
| 5,013,049 | 5/1991 | Tomaszewski | 273/292 |
| 5,098,107 | 3/1992 | Boylan et al. | 273/292 |
| 5,154,429 | 10/1992 | LeVasseur | 273/292 |
| 5,288,081 | 2/1994 | Breeding | 273/292 |
| 5,314,193 | 5/1994 | Ferrer | 273/292 |
| 5,366,228 | 11/1994 | Kangsanaraks | 273/292 |
| 5,368,305 | 11/1994 | Rodda et al. | 273/292 |

FOREIGN PATENT DOCUMENTS

| | | | |
|---|---|---|---|
| 9216269 | 10/1992 | WIPO | 273/292 |

*Primary Examiner*—Benjamin H. Layno
*Attorney, Agent, or Firm*—Richard C. Litman

[57] ABSTRACT

A card game provides for wagering on the occurrence of a numerically superior hand, and further provides for automatic payouts for the occurrence of three of a kind in a player hand during the play of the hand. At least one standard deck of cards is used, with the ace through nine of each suit respectively being valued at one through nine points, and the ten through king of each suit having no value. The object of the game is to arrive at a total point count of nine in the hand of two or three cards, with the player (or dealer) coming closest to nine, winning the hand; the tens digit is dropped if the card values exceed ten. Two cards are initially dealt to the players and dealer, with the dealer's first card being dealt face up. The dealer is limited to inflexible rules governing the drawing of a third card, but the players may draw a third card freely as desired. The occurrence of three of a kind in the dealer's hand effects the payoff of three of a kind hands for the player(s), with the player(s) being required to have exactly nine points under such conditions.

9 Claims, 3 Drawing Sheets

CARD GAME

This application is related to application Ser. No. 08/267,229 filed Jul. 5, 1994, and which was issued as U.S. Pat No. 5,366,228 on Nov. 22, 1994.

FIELD OF THE INVENTION

The present invention relates generally to card games, and more specifically to a wagering game in which players attempt to reach a count of nine. Players may win additional automatic payoffs for hands containing three of a kind.

BACKGROUND OF THE INVENTION

Various wagering card games have been developed in the past, such as blackjack (or twenty one), baccarat, seven and a half, etc., in which the object is to reach a given maximum count, depending upon the values assigned to the cards according to the game rules. In many cases, exceeding maximum allowable predetermined count results in a "bust," in which the player is automatically eliminated from that hand with no further chance to win. Players are in many instances discouraged by such occurrences, and games in which players cannot "bust" may provide greater enjoyment for players, as they may continue to play the hand through the final card of the hand.

All of the above types of wagering games, in which the player attempts to most closely approach a predetermined value or count with his/her cards rely strictly upon the numerical value of the cards to determine the winning and losing hands. While generally the game rules are relatively simple, the games are nevertheless extremely fast paced at the casino level, in order to increase the income of the casino. Thus, it can be difficult for a novice player to keep up with the pace of the game and calculate the numerical differences and totals involved.

Accordingly, the need arises for a card game which may include the step of placing wagers or bets on the outcome of the hands, which game involves attempting to reach a predetermined count or value with the cards of each hand, depending upon the numerical values assigned to those cards according to the rules of the game. The game should not include rules in which players or the dealer "bust" by exceeding the predetermined total, and moreover should include additional means for players to win other than only considering the relative numerical values of the card hands. The game should also provide payoffs for the occurrence of three of a kind in a player hand, in which each of the three cards is of the same rank, in order to allow the novice player a means of easily determining a winning hand in addition to the numerical value.

DESCRIPTION OF THE PRIOR ART

U.S. Pat. No. 4,659,087 issued to Margaret Shen et al. on Apr. 21, 1987 discloses a Casino Game in which each player and the dealer is dealt two hands. Comparisons are made between the numerical values of the players' and dealer's hands, with the object being for the players' two hands to exceed the value of the dealer's two hands. The game is thus relatively complex, in that each player must arrange his/her cards into two hands with the point count as desired, and then compare each hand against each dealer hand. No disclosure is made of payoffs for flush or three of a kind hands, as provided by the present card game invention.

U.S. Pat. No. 5,013,049 issued to Joseph Tomaszewski on May 7, 1991 discloses a Card Game in which the object is to reach a total of 21 with the card hand. Exceeding that total is a "bust," in which the player automatically loses and may no longer play the hand. Cards may be discarded and further cards drawn, which is not permitted according to the present game rules. The resulting discarding and drawing results in each hand having a fixed number of cards at all times, unlike the present game. Ties may be broken using several methods, one of which includes a flush hand. However, the flush provides no payoff in and of itself, but rather is only used to break a numerical tie, unlike the present game.

U.S. Pat. No. 5,098,107 issued to Eugene B. Boylan et al. on Mar. 24, 1992 discloses a Method And Apparatus For Playing A Wagering Game in which additional cards or symbols are added to a conventional card deck. Wagers are made on the occurrence of various combinations of cards, including straights, flushes, and pairs, as well as the occurrence of the additional symbols, in the manner of poker or the like. No numerical value is considered for the card hands of the game, as is provided in the present invention.

U.S. Pat. No. 5,154,429 issued to Richard A. LeVasseur on Oct. 13, 1992 discloses a Method Of Playing Multiple Action Blackjack in which the players are each dealt a single hand, with the dealer being dealt two consecutive hands. Play of the first and second dealer hands and the player hands is conventional, with each player allowed to place a wager on the outcome of each of the dealer hands. Each player uses the same hand against each dealer hand. Conventional blackjack or twenty one rules are otherwise used.

U.S. Pat. No. 5,288,081 issued to John G. Breeding on Feb. 22, 1994 discloses a Method Of Playing A Wagering Game using conventional poker hand values, but allowing the players to divide their bets into three components. The dealer turns over one card at a time from his/her hand, whereupon players are allowed to withdraw a portion of their bets if they wish, prior to the dealer turning up the next card. No comparisons of the numerical values of the hands is made, in accordance with the rules of poker.

U.S. Pat. No. 5,314,193 issued to Emilio Ferrer on May. 24, 1994 discloses a Method Of Playing A Wagering Casino Type (sic) in which numbered cards are valued according to their numbers, and face or court cards each have a value of one half. The game is similar to seven and one half insofar as card values are concerned, but the object is to achieve as high a value as possible so long as one half point is included in the value of the hand. The maximum value of a hand is ten and one half, with values exceeding that having the tens digit dropped. No provision for flush hands in addition to or along with other scoring, is provided.

U.S. Pat. No. 5,366,228 issued to Adisorn Kangsanaraks on Nov. 22, 1994 discloses a Card Game similar to the present card game invention, in that the players and dealer attempt to reach a total of nine points with the cards of their hands, with the highest total winning. It is not possible to "bust," as only the singles digit is counted. The players also have the option of betting on the probability of their two or three card hands being flush or comprising three of a kind. These options complicate the game somewhat, and the present game deletes these options in the interest of simplicity. Payoffs are still made by the house to players who draw such three of a kind hands, however.

Finally, PCT Pat. No. WO 92/16269 to BET Technology, Inc. and published on Oct. 1, 1992 discloses a Wagering Game similar to the Boylan et al. game discussed further above; priority for this PCT patent is based upon the Boylan et al. patent discussed above. Accordingly, no resemblance is seen to the present game.

None of the above noted patents, taken either singly or in combination, are seen to disclose the specific arrangement of concepts disclosed by the present invention.

SUMMARY OF THE INVENTION

By the present invention, an improved card game is disclosed.

Accordingly, one of the objects of the present invention is to provide an improved game which uses at least one deck of standard playing cards, with numbered cards from ace through nine being valued at face value and tens and court cards having no value.

Another of the objects of the present invention is to provide an improved card game which object is to reach a total point count of nine, using the above card values.

Yet another of the objects of the present invention is to provide an improved card game which also provides payoffs for three of a kind hands having a point count either higher or lower than the dealer hand, in addition to hands closest to a count of nine.

Still another of the objects of the present invention is to provide an improved card game which three of a kind hand payoffs are also based upon the acquisition of a numerically winning hand.

A further object of the present invention is to provide an improved card game in which only the dealer is restricted to rigid, inflexible rules regarding the drawing of an additional card or standing pat on the initial deal.

An additional object of the present invention is to provide an improved card game which in the simplest of circumstances provides for the winning of a hand based upon numerical superiority, but in other circumstances requires achieving a specific numerical count in the hand in order to win.

Another object of the present invention is to provide an improved card game in which ties or standoffs are provided for.

Yet another object of the present invention is to provide an improved card game which is suitable for casino play.

A final object of the present invention is to provide an improved card game for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
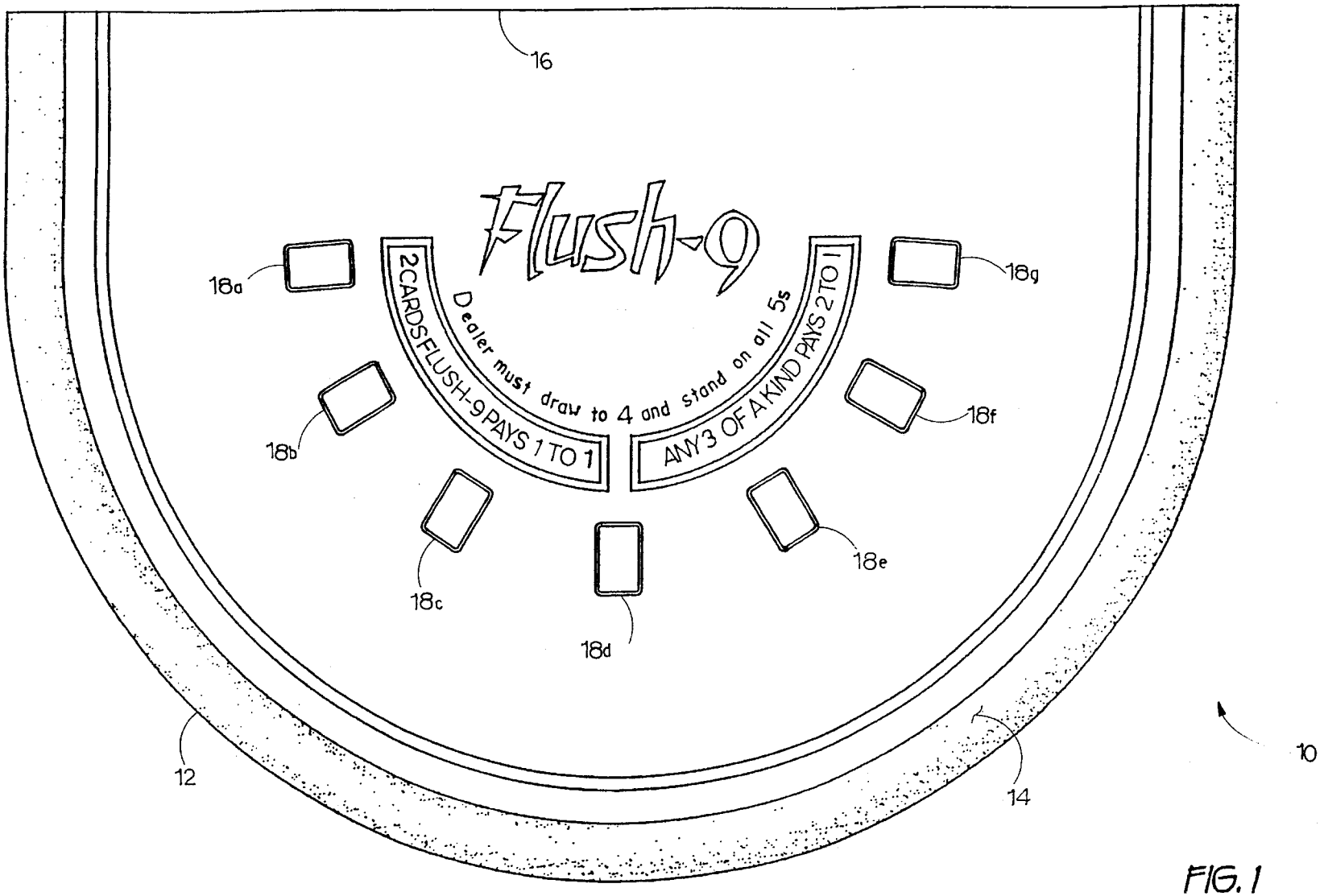
FIG. 1 is plan view of the game table provided for the present game, showing its various features.

Referring now to the drawings, the present invention will be seen to relate to a card game involving the occurrence of three of a kind hands, while simultaneously attempting to acquire a total of nine points based upon the values assigned to the cards. The present game is played using one or more standard decks of playing cards, with each deck comprising fifty two cards of four suits. Each suit contains thirteen cards, from ace (or one) through king. The ace through nine of each suit are counted at face value for purposes of determining the counting or point value of each hand, with the ten, jack, queen, and king of each suit having zero counting value in the present game.

FIG. 1 discloses a plan view of a gaming table layout 10 providing for the play of the present card game. The table 10 includes a semicircular or curved player periphery 12 with a cushion 14 therearound, and an opposite dealer periphery 16. The arrangement permits the dealer to face each of the plural players of the game, and for each of the players in turn to face the dealer.

Players place their bets in their respective betting boxes 18*a* through 18*g*, and the dealer initially deals two cards face down to each player and two cards to the dealer, with the first dealer card being dealt face up. Players are then permitted to look at their cards to determine further action. (It will be understood that the present table 10 may include positions for more or fewer players, as desired.)

As indicated further above, the object of the game is to achieve a total point count of nine with the two (or three) cards of the hand. In the event that a player achieves a nine point winning hand with two cards, which in addition is flush (i. e., both cards are of the same suit), the payoff to the player is one and one half to one (e.g., a $ 10 bet pays off at $ 15).

The present game provides further opportunities for players, in the form of the chance occurrence of three of a kind (i. e., three aces, three kings, etc.). Obviously, a three of a kind can only occur in a hand having three cards, i. e., one in which the dealer's initial count was four or less for his/her first two cards, or in which the player chose to accept a third card, as explained further below. The possibility of a three of a kind occurring in such hands may be seen as somewhat of a "wild card" opportunity, wherein a three of a kind hand is an almost automatic even money winning hand. The only times such a three of a kind hand would lose, is when the opposite hand contains only two cards totaling exactly nine points. As an example of the above, let us assume a player received a pair of cards of identical rank (e.g., fours, aces, jacks, etc.) for his/her first two cards, and chose to take a third card which turned out to be identical to the first two cards of the pair. This hand would automatically win even money, unless the dealer's hand was a two card hand totaling nine points—in which case the dealer's hand would win. The opposite is also true, in which the dealer has a three of a kind and the player has two cards totaling nine points. The above described three of a kind occurrences do not require any active betting on the part of the player(s) in order to win or lose according to the above described rules.

Figure 2A:
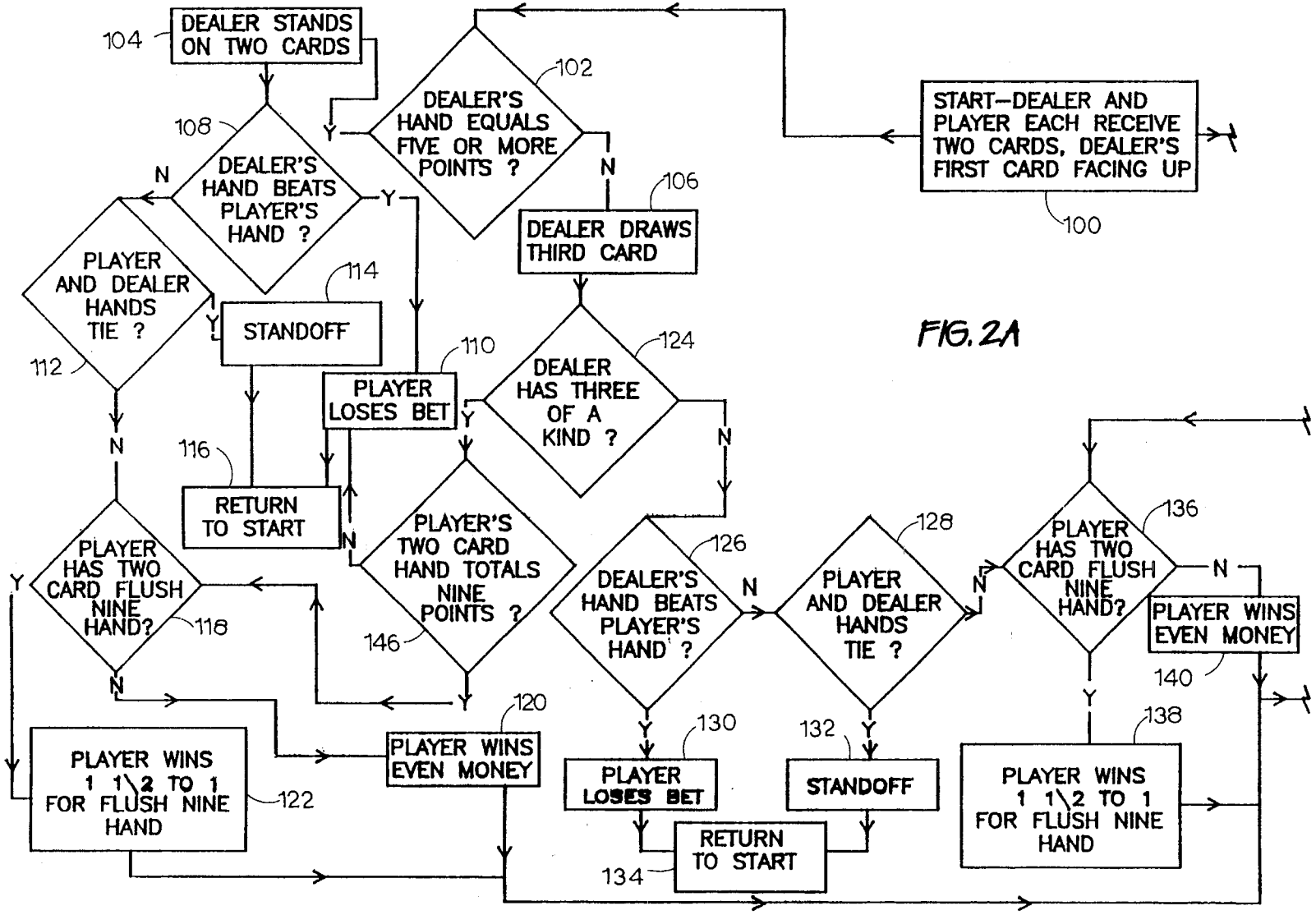
FIG. 2A is a first sheet of a block diagram or flow chart showing the steps involved in the play of the present card game.
Figure 2B:
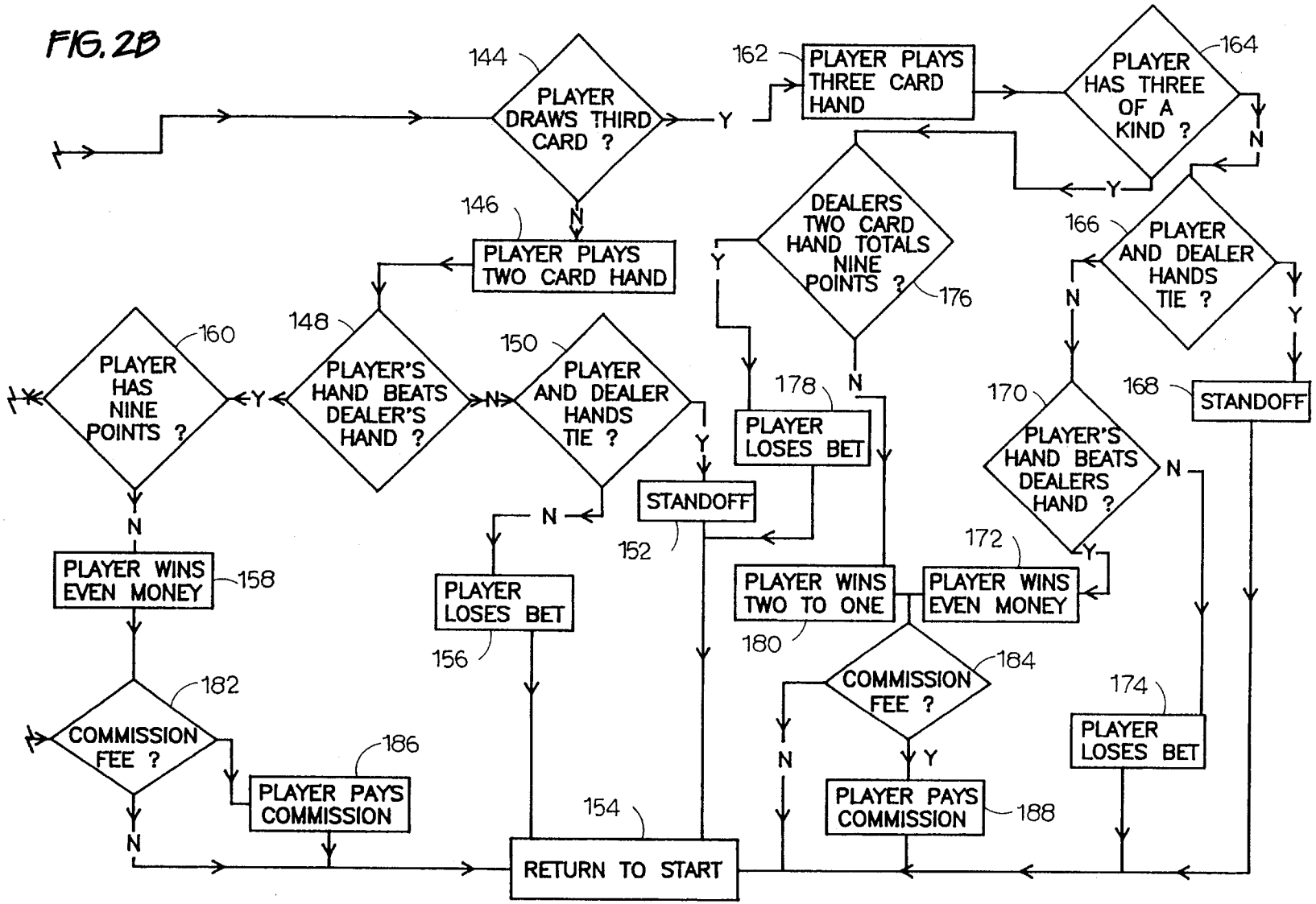
FIG. 2B is a second sheet of a block diagram or flow chart showing the steps involved in the play of the present card game.

FIGS. 2A and 2B disclose a flow chart showing the method of play of the present game. The chart of FIGS. 2A and 2B will be referred to throughout the balance of the specification. A starting position 100 is shown in the upper right portion of FIG. 2A, describing the dealing of the cards as above in the description of the table layout 10. Players are permitted to draw a third card at any time they wish, but the dealer is restricted to rigid and inflexible rules governing the drawing of a third card. The dealer must "stand," or continue to hold the original two cards dealt, if the dealer's point count for those two cards (one face up and one face down) are equal to five points or more, as indicated in the second step 102 and third step 104 of FIG. 2A. On the other hand, the dealer must draw a third card if the dealer's hand has a count of four or fewer points, as indicated by the step 106 of FIG. 2A. While most of the outcome will be similar whether the dealer (or any of the players) have two or three cards, obviously a player must have three cards in order to have three of a kind, which possibilities are discussed further below.

As an example of the above, let us assume that the dealer receives an eight for his/her first or "face up" card, and after dealing the second cards to all players and dealer, and third cards to any players requesting such, deals a third card to the dealer's hand. Players will then know that the dealer's total point count for the first two cards is less than five (the tens digit is dropped for any total over ten points), thus indicating that the dealer received a second card between two and six inclusive. For example, if the dealer had received a four for a second card, the total of four and eight would be twelve, whereupon the ten is dropped for a count of two, requiring the drawing of a third card.

As a further example, let us assume that the dealer received a face card (jack, queen, king) for his/her second card. As such face cards have no value in determining the count of the hand, only the initial face up card (e.g., eight) would count. In such a situation, with the dealer hand having a count of five or more points, the dealer must "stand," and not draw a third card, as in step 104 of FIG. 2A. The point count of the player hands is determined in exactly the same manner, but the players are not restricted to certain point totals in order to determine whether to draw a third card; a player may draw a third card after the dealing of the first two cards, no matter what the point count of the player's hand may be.

Assuming the dealer hand contains only two cards, the dealer and player hands are compared at this point, as shown in step 108 of FIG. 2A. If the dealer's hand beats the player's hand(s), as possible in step 108 of FIG. 2A, then the player(s) having the losing hand(s) lose their bet(s), as shown in step 110 of FIG 2A. On the other hand, if the dealer's hand does not beat the player's hand(s), as indicated in the decision block 112 of FIG 2A, then either the hands are tied ("standoff"), as indicated in step 114 of FIG. 2A, or the player(s) hand wins. Assuming the player loses or ties, as indicated in steps 110 and 114 of FIG 2A, play resumes to the starting point (step 116, FIG. 2A) with any tie bets being "rolled over" to the next hand.

There are two possible payoff situations for a player, depending upon the specific nature of his/her winning hand, as indicated in step 118, FIG. 2A. If the player hand merely has a higher point total than the dealer's hand (e.g., three points to two), then the payoff is at even money, as indicated in step 120, FIG. 2A. However, a payoff of one and one half to one (e.g., $15 for a $10 bet) is made if (and only if) the player's hand contains two cards having a total value of precisely nine points, and both cards are of the same suit ("flush"), as indicated in step 122, FIG. 2A. Winning player hands may be subject to payment of a commission fee (discussed below and shown in FIG. 2B) before returning to the start position for the play of another hand.

The above description of play assumes that no dealer hands containing three of a kind have occurred. In such an event, the following steps must be considered. If the dealer draws a third card, as in step 106 of FIG. 2A, then the possibility arises that the dealer may have drawn three like cards (three of a kind), as indicated in step 124. Assuming that the dealer's three card hand does not contain three of a kind, then the winning rank of the hands is the same as described above for a two card dealer hand, with the possibilities existing that the dealer's hand beats the player's hand (step 126, FIG. 2A), or does not beat the player's hand (i. e., loses or ties, as in step 128, FIG. 2A). If the dealer's three card hand beats the player's hand, then the player loses his/her bet (step 130, FIG. 2A). In the event the dealer's hand does not beat the player's hand, then either the two hands tie (standoff, step 128, FIG. 2A), or the player's hand wins.

A player may win at one and one half to one, if he/she is holding a two card hand of precisely nine points, with both cards being of the same suit ("flush nine" hand), as indicated by steps 136 and 138 of FIG. 2A. Winning hands not meeting the "flush nine" requirement pay even money (step 140). Winning player hands may be subject to payment of a commission fee (discussed below and shown in FIG. 2B) before returning to the start position.

However, if the dealer's hand does contain three of a kind, then the only way the player can win is if the player's hand is valued at exactly nine points, as indicated in step 142 of FIG. 2A. If (and only if) such is the case, the player wins even money (step 120) or one and one half to one (step 122), depending upon whether or not the nine point, two card hand is flush or not (step 118). (Again, winning player hands may be subject to payment of commission fees, discussed further below.) A two card player hand valued at less than nine points, or a three card player hand of any value (including nine points), loses against a three of a kind dealer hand, as indicated in step 110.

If the dealer draws three of a kind, the numerical superiority of either the dealer hand or the player hand(s) is irrelevant; the only way the player can win under such a condition is if his/her hand has a value of precisely nine points. However, if the dealer hand does not contain three of a kind, then the player hand need only be higher than the dealer hand in order to win, e. g., a player hand of six would beat a dealer hand of five or less. This is indicated in step 140 of FIG. 2A, wherein the player hand is not flush and/or does not have a value of nine points.

The discussion thus far has been primarily from the dealer's viewpoint. The remainder of the flow chart, disclosed primarily in FIG. 2B, is essentially from the viewpoint of a player of the present game, and will be discussed from that viewpoint in the following paragraphs. As indicated in the step 144 of FIG. 2B, a player has the option of drawing a third card after receiving his/her first two cards, without restriction as to the count of the first two cards. This is unlike the dealer hand, where the dealer is restricted according to the point count of the first two cards.

Assuming the player decides to "stand" and play with the original two cards dealt, as in step 146 of FIG. 2B, the player's two card hand is then compared to the dealer's two (or three) card hand, as in step 148 of FIG. 2B. If the two hands tie, as in step 150 of FIG. 2B, then a "standoff" occurs, as in step 152. Any bets are held over to the next hand, or allowed to "ride," and another hand is dealt, as indicated by the "Return to Start" step 154 of FIG. 2B. Alternatively, step 150 provides for a non-tie between the two hands, which in consideration of the non-winning case following from step 144, results in a loss for the player hand, as indicated by step 156 of FIG. 2B. Again, the game returns to the starting step 154, and new hands are dealt.

If the player's two card hand wins (one of the possibilities of step 148, FIG. 2B), then the payoff to the player will depend upon the specifics of his or her hand. Most hands will pay off at even money, as indicated by step 158 of FIG. 2B, but those player hands containing exactly nine points (step 160) wherein the two cards are of the same suit ("flush nine", step 136 of FIG. 2A) will pay off at one and one half to one, as indicated in step 138 of FIG. 2A.

In the event a player draws a third card and plays a three card hand, as in step 162 of FIG. 2B, a chain of steps occurs which is similar to that described above from the viewpoint of the dealer. When the player draws a third card, the possibility exists that the player may have drawn three cards of identical rank (three of a kind), as indicated by step 164 of FIG. 2B. Assuming the player does not have three of a kind, then the relative values of the dealer's and player's hand(s) are compared. If the values are equal and the hands tie, as in one of the possibilities of step 166 of FIG. 2B, then a "standoff" occurs (step 168), with play returning to the start for another hand, as indicated by step 154. If the hands do not tie, then the player's hand(s) may beat the dealer's hand (step 170), whereupon the player wins even money (step 172), or the dealer's hand may beat the player's hand(s), whereupon the player(s) lose(s), as indicated in step 174. It will be noted that no two card "flush nine" payoff is provided to a player here, as the player is holding a three card hand.

If a player draws three of a kind (the second possibility of step 164), then the only way the player can lose, is if the dealer's two card hand contains exactly nine points (step 176, FIG. 2B). If such occurs, then the player will lose his/her bet, as indicated in the step 178 of FIG. 2B. This scenario is analogous to that described above and shown in FIG. 2A, when the dealer draws three of a kind and the player must have a two card hand totalling nine points to win. In any event, the drawing of three of a kind results in an automatic win, unless the opponent has a two card hand valued at precisely nine points.

If the player has drawn three of a kind, and the dealer does not have a two card nine point hand, then the player not only wins regardless of the relative values of the player's and dealer's hands, but the winning payoff is at two to one, as indicated by step 180 of FIG. 2B. Thus, a player may draw three kings, having value of zero points (since face cards have no value in the present game), while the dealer draws a hand worth eight points. So long as the player has three of a kind—no matter what the value—and the dealer's hand is worth less than nine points (or contains three cards), the player will win at two to one.

As noted, the present card game specifically makes no provision for any additional bets by players, other than on the occurrence of a numerically superior hand. Any additional payoffs for three of a kind hands are automatically awarded by the house. Hence, the house is not taking in any additional wagers from the players on the occurrence of flush or three of a kind hands, yet must provide a payout on such hands if they are otherwise winning hands. Thus, it will be seen that a less than optimum margin for the house may be provided by the present game, when used as a gambling casino type card game.

Accordingly, the present game may provide for an optional additional percentage or "commission" to be taken from the winning bets of the players of the game, in order to provide an adequate return for the house. This is indicated by the "commission fee" steps 182 and 184 respectively for a winning two card hand and three card hand in FIG. 2B. (It will be noted that the winning two card hands 120,122,138, and 140 of FIG. 2A also flow to the "commission fee" step 182 of FIG. 2B, thus providing for the option of the house collecting such a commission on any winning player hand.)

If the house collects such a commission (nominally five percent, or another words, providing a net payout of 0.95 to one for otherwise even money bets; greater or lesser amounts may be provided for, depending upon the house rules), then the player is obligated to pay the commission fee to the house, as indicated in the "Player pays commission" steps 186 and 188 respectively for two card and three card winning hands, in FIG. 2B. Again, the step of payment of a commission fee may be eliminated by reducing the payout by the house for winning bets, if desired.

In summary, the above described game will be seen to provide numerous winning possibilities for a player, from merely drawing a numerically superior hand, to the possibility of an automatic win for a three of a kind hand. The experienced player may enjoy the relatively fast pace, while a less experienced player may enjoy the relatively simple concept of attempting to gain a hand valued closest to nine points. Moreover, players cannot exceed the predetermined total of nine points, as only the ones digit is used when counting the point value of a hand. This adds further interest to the game, as it is impossible for a player to "bust" by exceeding the predetermined total, and accordingly be eliminated from play, as in many other games. In the present game a player always has a chance to win, up to the actual comparison of player and dealer hands, which adds interest to the game for the players involved. The additional freedom the player enjoys in being able to draw a third card at any time during the deal, also provides some advantage for the experienced player over the dealer, as the dealer is restricted by rigid inflexible rules governing the drawing of a third card for play of the dealer hand. The result of the above is a game which is fast paced for the experienced player, with many nuances and possibilities, and which still provides for ease of play for the less experienced player. The game holds the interest of all players, due to the impossibility of "busting" a hand, and the astute player may gain some advantage due to his/her unlimited third card option.

It is to be understood that the present invention is not limited to the sole embodiment described above, but encompasses any and all embodiments within the scope of the following claims.

I claim:

1. A method of playing a card game, comprising the following steps:

(a) Providing at least one deck of playing cards comprising four suits totaling fifty two cards, with each suit including thirteen cards ranking from ace through king;

(b) assigning a value to each of the cards with the ace through nine of each suit respectively being assigned values of one through nine points, and the ten through king of each suit each being assigned a value of zero;

(c) placing wagers on the outcome of play of the card game;

(d) forming dealer and player hands by dealing two of the cards randomly to each player and to the dealer of the game, with the first card to the dealer being dealt face up and all others face down, and;

(e) adding the values of the cards in each of the hands and dropping the tens digit to provide a number between zero and nine points, and determining a winning hand by determining which hand is closest to a total of nine points.

2. The method of playing a card game according to claim 1, including the step of:

(a) canceling all wagers when dealer and player hands have equal values.

3. The method of playing a card game according to claim 1, including the step of:

(a) losing any player wager when the dealer hand totals nine points and is higher than the player hand.

4. The method of playing a card game according to claim 1, including the steps of:

(a) requiring the dealer to stand with a two card total of five points or more points and to draw a third card with a two card total of four or fewer points, and;

(b) allowing each player to draw a third card as desired.

5. The method of playing a card game according to claim 4, including the steps of:

(a) determining whether any of the hands are formed entirely of cards of the same suit to form a flush hand, and;

(b) determining whether any three card hands are formed of three cards of equal rank from three different suits to form three of a kind.

6. The method of playing a card game according to claim 5, including the steps of:

(a) providing a payoff of one and one half times the amount wagered for two card flush hands having a value of nine points, and;

(b) providing a payoff of twice the amount bet for hands formed of three of a kind.

7. The method of playing a card game according to claim 6, including the step of:

(a) losing any player wager when the dealer hand totals nine points and is higher than the player hand.

8. The method of playing a card game according to claim 5, including the step of:

(a) losing any player wager when the dealer hand is flush and totals nine points, and is numerically higher than the player hand.

9. The method of playing a card game according to claim 5, including the step of:

(a) losing any player wager when the dealer hand includes three of a kind and totals nine points, and is numerically higher than the player hand.

* * * * *